US012643141B2

(12) United States Patent
Liu et al.

(10) Patent No.: US 12,643,141 B2
(45) Date of Patent: Jun. 2, 2026

(54) FORGING METHOD FOR HIGH-SILVER ALUMINUM ALLOY AND HIGH-SILVER ALUMINUM ALLOY FORGED PART

(71) Applicants: Central South University, Changsha City (CN); Changsha Xingxiao Material Technology Co., Ltd., Changsha City (CN)

(72) Inventors: Zhiyi Liu, Changsha City (CN); Pingjun Liu, Changsha City (CN)

(73) Assignees: Central South University, Changsha City (CN); Changsha Xingxiao Material Technology Co., Ltd., Changsha City (CN)

( * ) Notice: Subject to any disclaimer, the term of this patent is extended or adjusted under 35 U.S.C. 154(b) by 666 days.

(21) Appl. No.: 18/071,886

(22) Filed: Nov. 30, 2022

(65) Prior Publication Data

US 2023/0166321 A1 Jun. 1, 2023

(30) Foreign Application Priority Data

Nov. 30, 2021 (CN) ..... 202111439959.1

(51) Int. Cl.
*B21J 1/04* (2006.01)
*C22C 21/12* (2006.01)
*C22F 1/057* (2006.01)

(52) U.S. Cl.
CPC ..... *B21J 1/04* (2013.01); *C22C 21/12* (2013.01); *C22F 1/057* (2013.01)

(58) Field of Classification Search
None
See application file for complete search history.

(56) References Cited

U.S. PATENT DOCUMENTS

2014/0102602 A1* 4/2014 Bush ..... C22C 21/16 148/690

FOREIGN PATENT DOCUMENTS

| | | | |
|---|---|---|---|
| CN | 101245430 | | 8/2008 |
| CN | 102206794 | | 10/2012 |
| CN | 103748246 | | 4/2014 |
| CN | 103924139 | | 7/2014 |
| CN | 104015011 | A * | 9/2014 |
| CN | 104046932 | | 9/2014 |
| CN | 106498248 | | 3/2017 |
| CN | 106498318 | | 3/2017 |
| CN | 108213843 | | 6/2018 |
| CN | 110434264 | A * | 11/2019 |
| CN | 110560617 | | 12/2019 |
| CN | 111373861 | | 12/2019 |
| CN | 115608897 | A * | 1/2023 |

OTHER PUBLICATIONS

English translation of CN 104015011 (originally published Sep. 3, 2014), obtained from PE2E search.*
English translation of CN 110434264 (originally published Nov. 12, 2019), obtained from PE2E search.*
English translation of CN 115608897 (originally published Jan. 17, 2023), obtained from PE2E search.*

* cited by examiner

*Primary Examiner* — David C Mellon
(74) *Attorney, Agent, or Firm* — McDonnell Boehnen Hulbert & Berghoff LLP

(57) ABSTRACT

Disclosed is a forging method for a high-silver aluminum alloy and a high-silver aluminum alloy forged part are provided. The forging method comprises the following steps: heating the high-silver aluminum alloy to 440° C. to 500° C., and holding for 8 to 16 hours to obtain a blank; preheating a contact portion of a forging anvil, a tong or a die with the blank to 300° C. to 480° C., and holding in the process of transferring the blank to a press; carrying out six-upsetting six-stretching multidirectional forging deformation on the blank, thus obtaining a forging blank, wherein the final forging temperature is 360° C. to 400° C.; and carrying out forming forging treatment on the forging blank, and then carrying out solid solution treatment, residual stress elimination and artificial aging treatment in sequence.

9 Claims, No Drawings

FORGING METHOD FOR HIGH-SILVER ALUMINUM ALLOY AND HIGH-SILVER ALUMINUM ALLOY FORGED PART

CROSS-REFERENCE TO RELATED APPLICATION

This patent application claims the benefit and priority of Chinese Patent Application No. 202111439959.1, filed with the China National Intellectual Property Administration on Nov. 30, 2021, the disclosure of which is incorporated by reference herein in its entirety as part of the present application.

TECHNICAL FIELD

The present disclosure belongs to the technical field of processing of forged parts, and in particular relates to a forging method for a high-silver aluminum alloy, and a high silver aluminum alloy forged part.

BACKGROUND

The function of silver (Ag) element in the aluminum alloy is mainly to improve the heat resistance and corrosion resistance. In the past, in aluminum alloys, Ag elements are usually added as trace alloying elements. However, as research progresses, the function of Ag in the aluminum alloys is becoming more widely recognized; and its application in the aluminum alloy is becoming wider, and its adding amount is getting more. For example, many aluminum alloys developed in the Research group contain Ag elements, especially some novel Al—Cu series high-strength and heat-resistant aluminum alloys which are developed in recent years and high in alloying degree, in which Ag has become the main alloying element. The Al—Cu series high-strength and heat-resistant aluminum alloys mainly include: (1) a high-heat-resistant Al—Cu—Mg—Ag alloy (ZL200810030979.1); (2) a method (ZL201110093645.0) for improving mechanical property of aging-strengthened aluminum-copper-magnesium-silver alloy after solid solution cold deformation; and (3) an aluminum-copper-magnesium-silver alloy with excellent high-temperature performance and a heat treatment method thereof (ZL201618000350.8). The content of Ag in these newly developed novel aluminum alloys is as high as 1.85%.

However, although the newly developed high-Ag aluminum alloy above is excellent in performance, its forging is a major problem, such as forging cracking, small forging temperature range, and high final forging temperature. For the existing conventional forging processes for the aluminum-copper alloy (ZL201910763894.2, ZL201410171279.X, ZL 201611154601.3) and the 7000 series high-strength aluminum alloy (ZL201410295234.3) cannot solve the forging problem of the high-Ag aluminum alloy, thus a new forging process technology must be developed to solve this problem.

SUMMARY

The embodiment of the present disclosure provides a forging method for a high-Ag aluminum alloy, aiming at solving the problems that an existing aluminum alloy forging process cannot solve the problems of forging cracking, small forging temperature interval, high final forging temperature and the like of the high-Ag aluminum alloy.

The embodiment of the present disclosure is implemented in such a way that a forging method for a high-silver aluminum alloy comprises:

heating the high-silver aluminum alloy to 440° C. to 500° C., and holding for 8 to 16 hours to obtain a blank;

preheating a contact portion of a forging anvil, a tong or a die with the blank to 300° C. to 480° C., and holding in the process of transferring the blank to a press;

carrying out six-upsetting six-stretching multidirectional forging deformation on the blank at a pressing speed of the press of 3 mm/s to 10 mm/s, thus obtaining a forging blank, wherein the final forging temperature is 360° C. to 400° C.;

carrying out forming forging treatment on the forging blank to obtain a forged part; and carrying out solid solution treatment, residual stress elimination and artificial aging treatment in sequence.

The embodiment of the present disclosure further provides a high-Ag aluminum alloy forged part which is prepared by using a forging method for the high-Ag aluminum alloy above.

According to the forging method for the high-silver aluminum alloy provided by the embodiment of the present disclosure, the problems of forging cracking and structure uniformity of the Ag-containing aluminum alloy can be effectively solved, and thus the high-Ag aluminum alloy forged part with excellent performance and basically consistent mechanical performance in all directions is obtained. The forging method is high in operability and efficiency, the product needing repeated upsetting-stretching can be formed by one heat, and the surface quality after forming is good.

DETAILED DESCRIPTION OF THE EMBODIMENTS

To make the objective, technical solution and advantages of the present disclosure more clearly, the present disclosure is further described in detail below with reference to specific embodiments. It should be understood that the specific embodiments described here are merely illustrative of the present disclosure rather than limiting the present disclosure.

The embodiment of the present disclosure provides a forging method for a high-silver aluminum alloy, which is suitable for 2000 series, 6000 series and 7000 series aluminum alloy containing high Ag or 2000 series aluminum alloy containing high Ag and high Cu and is divided into a blank forging process and a forming forging process.

The blank forging process comprises the following steps:

Step S1: the high-silver aluminum alloy is heated to 440° C. to 500° C. and then held for 8 to 16 hours to obtain a blank.

In the embodiment of the present disclosure, the high-silver aluminum alloy is prepared from the following components in percentage by weight: less than or equal to 0.06% of Si, less than or equal to 0.05% of Fe, 5.6% to 6.8% of Cu, 0.25% to 0.6% of Mg, 0.9% to 1.85% of Ag, 0.2% to 0.4% of Mn, 0.08% to 0.10% of Zr, 0.03% to 0.15% of Ti, and the balance of Al.

In the embodiment of the present disclosure, a high-Ag and high-Cu aluminum ingot is heated to a high temperature (440° C. to 500° C.) and held for a long time (8 to 16 hours) so as to dissolve a part of the Ag-containing second phase into an aluminum alloy matrix, thus the plasticity and forging deformation of the blank during forging are improved, and forging cracking is avoided.

Step S2: a contact portion of a forging anvil, a tong or a die with the blank is preheated to 300° C. to 400° C. and held in the process of transferring the blank to a press.

In the embodiment of the present disclosure, before the step S2, the forging anvil is subjected to rounding treatment in advance, with a fillet of R5 to R50, thus avoiding cracks at the forging joint, i.e., to prevent the forging blank from being scratched and cracking in the blank forging process.

In the embodiment of the present disclosure, in the process of transferring the blank to the press, the blank is held. Insulation cotton or other ways can be adopted for holding so as to reduce the temperature drop of the blank as much as possible.

In the embodiment of the present disclosure, the preheating treatment (300° C. to 480° C.) at the contact portion of the forging base type iron, a clamp, the tong, the die and the like with the silver aluminum alloy can prevent the blank from rapid temperature drop in the forging process, i.e., prevent the heat of the heat-resistant aluminum alloy from losing too quickly.

Step S3: the blank is subjected to six-upsetting six-stretching multidirectional forging deformation at a pressing speed of the press of 3 mm/s to 10 mm/s, thus obtaining a forging blank, wherein the final forging temperature is controlled at 360° C. to 400° C.

In the embodiment of the present disclosure, the blank is subjected to six-upsetting six-stretching multi-directional deformation blank forging with a large amount of deformation, wherein the amount of deformation of each pass in each direction is 40% to 60%, such that the second-phase particles containing high Ag and casting dendritic structures are crushed to be distributed uniformly, it is guaranteed that the structure properties in all directions are basically consistent, that is, the uniformity of the deformation structures is guaranteed. The pressing speed of the press is 3 mm/s to 10 mm/s, pressing is firstly carried out at a low speed (3 mm/s to 5 mm/s) to force a slip system which is easy to be activated in the aluminum alloy to be activated, and heat energy generated inside the aluminum alloy due to the activation of the slip system may activate other slip systems. The initially crushed casting structure is free of cracking tendency due to the low pressing speed, and then the pressing speed is gradually increased to 7 mm/s to 10 mm/s. The pressing rate of the press is from slow to fast, thus preventing the forging blank from cracking.

In the embodiment of the present disclosure, the adoption of the high final forging temperature (360° C. to 400° C.) is to guarantee the high-Ag aluminum alloy forging blank to have enough plasticity, thus avoiding forging cracking.

It needs to be noted that cylindrical and square forged parts can be forged by one heat; while the flat forged parts require intermediate annealing treatment in the forging deformation process so as to avoid the cracking in the forging process. Specifically, the increase of the amount of deformation may cause deformation heat inside the aluminum alloy; for the cylindrical or square forged parts, the heat loss and the generation of internal deformation heat approximately achieve a dynamic balance, and at the moment, the repeated upsetting-stretching of the blank can be completed at the condition that the blank temperature doesn't fall outside the final forging temperature range. In addition, if the temperature falls outside the final forging range, the flat forged part needs to be subjected to annealing in furnace due to its large specific area, wherein the annealing is carried out the temperature of 440° C. to 500° C. and lasts for 0.5 h to 5 h; and air cooling is carried out after forging. The forging carried out by using above method can effectively prevent the high-Ag aluminum alloy from cracking tendency, thus obtaining a forged part with excellent performance.

In the embodiment of the present disclosure, the intermediate annealing treatment is carried out at the temperature of 420° C. to 480° C. and lasts for 4 hours to 8 hours.

In the embodiment of the present disclosure, the generation conditions of edge cracks and surface cracks are observed at any time in the blank forging deformation process, and repairing treatment can be carried out at any time. The repairing in the forging process is to prevent the edge cracks that appear in the forging blank from expanding and penetrating deep into the forging blank to cause the forging blank to be scrapped.

The forming forging process comprises the following steps:

Step S4: the forging blank is subjected to forming forging treatment to obtain a forged part.

In the embodiment of the present disclosure, the forming of plate-shaped forged parts and rod-shaped (bar-shaped) forged parts is to put the forging blank in the furnace to be heated to 440° C. to 500° C. and held for 6 hours to 8 hours. The forging clamp, the die and an upsetting iron are preheated; and then the forging blank is rapidly stretched and forged to the specified blank size to prevent the forging blank from cracking due to rapid heat loss. The final forging temperature is controlled at 360° C. to 400° C. For the plate-shaped forged parts and the rod-shaped forged parts, the forging blank is rapidly stretched and forged to the specified size on the premise that the upsetting iron, the clamp and the die are preheated, thus preventing the generation of the forging cracks caused by the heat loss of the forging blank. The amount of deformation in the forming of the plate-shaped and rod-shaped forged parts is greater than or equal to 80%.

In the embodiment of the present disclosure, the forming of the forged ring is to carry out the following processing treatment on a cylindrical forged part blank subjected to blank forming deformation: (a) a forged ring blank is put into the furnace to be heated to 440° C. to 500° C. and then held for 6 hours to 8 hours; (b) the forging blank is subjected to upsetting, punching, core-bar stretching and finishing to form a ring blank; (c) a roller of a ring rolling mill is coated with lubricating oil; (d) the steel ring is subjected to ring rolling in advance, and the roller is heated by using the steel ring at the high temperature (1000° C. to 1100° C.); and (e) the ring blank is loaded into a core roller, the forging blank is lightly pressed by using an axial roller, and axial deformation is carried out by using the small amount of deformation (5% to 20%). Through the cooperation of a main roller and the core roller, radial ring rolling deformation is carried out by using the large amount of deformation (greater than or equal to 30%). The final forging temperature is controlled at 360° C. to 400° C.

For the cylindrical forged parts, the high-directional deformation and the deformation uniformity of the forging blank can be increased by employing core-bar stretching deformation after upsetting and punching. The coating of the lubricating oil on the roller of the ring rolling mill may reduce the friction between the roller and the forging blank so as to avoid surface cracks. Pre-ring rolling of the steel parts can preheat the portions, in contact with the aluminum alloy forging blank, of the shaft roller of the ring rolling machine and the like, thus preventing the aluminum alloy forging blank from rapid heat loss and completing the ring rolling process at one time.

In the embodiment of the present disclosure, the formed forged part needs to be subjected to repairing treatment.

Step S5: the forged part is subjected to solid solution treatment, residual stress elimination treatment, and artificial aging treatment.

In the embodiment of the present disclosure, the solid solution treatment is carried out at the temperature of 480° C. to 520° C. and lasts for 3 hours to 6 hours.

In the embodiment of the present disclosure, the tensile or bulging deformation of the residual stress elimination treatment is 0.1% to 2.0%.

In the embodiment of the present disclosure, the artificial aging treatment is carried out at the temperature of 150° C. to 180° C. and lasts for 12 hours to 24 hours.

The embodiment of the present disclosure further provides a high-silver aluminum alloy forged part, which is prepared by using the forging method above for the high-silver aluminum alloy.

Embodiments of certain implementations of the present disclosure are given below and are not intended to limit the scope of the present disclosure.

Embodiment I

A 2A43 plate-shaped forged part is forged, the high-Ag aluminum ingot is prepared from the following components: 0.06% of Si, 0.06% of Fe, 6.8% of Cu, 0.25% of Mg, 0.90% of Ag, 0.40% of Mn, 0.15% of Zr, 0.05% of Ti, and the balance of Al.

The blanking forging steps are as follows:

A high-Ag aluminum ingot is heated to 500° C. and held for 8 hours to obtain a blank. A forging anvil is subjected to rounding treatment in advance, with a fillet of R25. In the process of transferring the blank to a press, insulation cotton is adopted for the holding of the blank; a contact portion of the forging anvil, a tong or a die with the aluminum alloy is preheated to 300° C. in advance. The blank is subjected to six-upsetting six-stretching multi-directional deformation blank forging, and the amount of deformation of each pass in each direction is 40%. Pressing is carried out at a low speed of 3 mm/s, and then the pressing speed is gradually increased to 8 mm/s, and intermediate annealing treatment is carried out in the forging deformation process, wherein the annealing is carried out at the temperature of 440° C. and lasts for 5 h; air cooling is carried out after forging so as to obtain a forging blank; the final forging temperature is controlled at 400° C. The generation conditions of edge cracks and surface cracks are observed at any time in the blank forging deformation process, and the repairing treatment is treated at any time.

The forming forging steps are as follows:

The forging blank is put into the furnace again to be heated to 440° C. and then held for 8 hours; the forging clamp, the die and the upsetting iron are preheated to 400° C., and then the forging blank is rapidly stretched and forged to a specified blank size, thus preventing the forging blank from cracking due to rapid heat loss, wherein the amount of deformation is greater than or equal to 80%, and the final forging temperature is controlled at 360° C. The forged part is subjected to solid solution treatment at the solution treatment process parameters of 480° C./6 hours; the forged part after solid solution treatment is subjected to residual stress elimination treatment with the tensile or bulging amount of deformation of 0.1%; and the forged part is further subjected to artificial aging treatment at the process parameters of 150° C./24 hours.

The plate-shaped forged part obtained in the embodiment I of the present disclosure is good in surface quality and free of defects and cracks. The plate-shaped forged part obtained in the embodiment I is subjected to room-temperature mechanical property testing according to the Chinese national standard (GB/T 228.1-2010), and the testing results are as shown in Table 1.

TABLE 1

| Sampling direction | $\sigma_b$ (MPa) | $\sigma_{0.2}$(MPa) | $\delta_5$(%) |
|---|---|---|---|
| Transverse direction | 502 | 473 | 7.0 |
| Longitudinal direction | 497 | 473 | 7.0 |

Embodiment II

A 2A43 plate-shaped forged part is forged, the high-Ag aluminum ingot is prepared from the following components: 0.06% of Si, 0.06% of Fe, 6.0% of Cu, 0.35% of Mg, 1.2% of Ag, 0.35% of Mn, 0.08% of Zr, 0.15% of Ti, and the balance of Al.

The blanking forging steps are as follows:

A high-Ag aluminum ingot is heated to 480° C. and held for 12 hours to obtain a blank. A forging anvil is subjected to rounding treatment in advance, with a fillet of R25. In the process of transferring the blank to a press, insulation cotton is adopted for the holding of the blank. A contact portion of the forging anvil, a tong or a die with the aluminum alloy is preheated to 400° C. in advance; the blank is subjected to six-upsetting six-stretching multi-directional deformation blank forging, and the amount of deformation of each pass in each direction is 50%. Pressing is carried out at a low speed of 4 mm/s, and then the pressing speed is gradually increased to 9 mm/s, and intermediate annealing treatment is carried out in the forging deformation process, wherein the annealing is carried out at the temperature of 480° C. and lasts for 1.5 h; air cooling is carried out after forging so as to obtain a forging blank; the final forging temperature is controlled at 360° C. The generation conditions of edge cracks and surface cracks are observed at any time in the blank forging deformation process, and the repairing treatment is treated at any time.

The forming forging steps are as follows:

The forging blank is put into the furnace again to be heated to 460° C. and then held for 7 hours; the forging clamp, the die and the upsetting iron are preheated, and then the forging blank is rapidly stretched and forged to a specified blank size, thus preventing the forging blank from cracking due to rapid heat loss, wherein the amount of deformation is greater than or equal to 80%, and the final forging temperature is controlled at 380° C. The forged part is subjected to solid solution treatment at the solution treatment process parameters of 480° C./6 hours; the forged part after solid solution treatment is subjected to residual stress elimination treatment with the tensile or bulging amount of deformation of 0.5%; and the forged part is further subjected to artificial aging treatment at the process parameters of 180° C./12 hours.

The plate-shaped forged part obtained in the embodiment II of the present disclosure is good in surface quality and free of defects and cracks. The plate-shaped forged part obtained in the embodiment II is subjected to room-temperature mechanical property testing according to the Chinese national standard (GB/T 228.1-2010), and the testing results are as shown in Table 2.

TABLE 2

| Sampling direction | $\sigma_b$ (MPa) | $\sigma_{0.2}$(MPa) | $\delta_5$(%) |
|---|---|---|---|
| Transverse direction | 535 | 505 | 10.0 |
| Longitudinal direction | 518 | 491 | 9.0 |

TABLE 3

| Sampling direction | $\sigma_b$ (MPa) | $\sigma_{0.2}$(MPa) | $\delta_5$(%) |
|---|---|---|---|
| Transverse direction 1 | 496 | 462 | 7.5 |
| Transverse direction 2 | 494 | 459 | 6.0 |
| Longitudinal direction1 | 503 | 472 | 11.0 |
| Longitudinal direction 2 | 507 | 477 | 7.5 |

Embodiment III

A 2A43 plate-shaped forged part is forged, the high-Ag aluminum ingot is prepared from the following components: 0.06% of Si, 0.06% of Fe, 5.7% of Cu, 0.4% of Mg, 1.3% of Ag, 0.3% of Mn, 0.10% of Zr, 0.10% of Ti, and the balance of Al.

The blanking forging steps are as follows:

A high-Ag aluminum ingot is heated to 460° C. and held for 14 hours to obtain a blank. A forging anvil is subjected to rounding treatment in advance, with a fillet of R25. In the process of transferring the blank to a press, insulation cotton is adopted for the holding of the blank. A contact portion of the forging anvil, a tong or a die with the aluminum alloy is preheated to 480° C. in advance; the blank is subjected to six-upsetting six-stretching multi-directional deformation blank forging, and the amount of deformation of each pass in each direction is 40%; pressing is carried out at a low speed of 3 mm/s, and then the pressing speed is gradually increased to 7 mm/s, and intermediate annealing treatment is carried out in the forging deformation process, wherein the annealing is carried out at the temperature of 480° C. and lasts for 3 h; air cooling is carried out after forging so as to obtain a forging blank; the final forging temperature is controlled at 380° C. The generation conditions of edge cracks and surface cracks are observed at any time in the blank forging deformation process, and the repairing treatment is treated at any time.

The forming forging steps are as follows:

The forging blank is put into the furnace again to be heated to 480° C. and then held for 6 hours; the forging clamp, the die and the upsetting iron are preheated, and then the forging blank is rapidly stretched and forged to a specified blank size, thus preventing the forging blank from cracking due to rapid heat loss, wherein the amount of deformation is greater than or equal to 80%, and the final forging temperature is controlled at 400° C. The forged part is subjected to solid solution treatment at the solution treatment process parameters of 490° C./5 hours; the forged part after solid solution treatment is subjected to residual stress elimination treatment with the tensile or bulging amount of deformation of 1.0%; and the forged part is further subjected to artificial aging treatment at the process parameters of 160° C./20 hours.

The plate-shaped forged part obtained in the embodiment III is subjected to room-temperature mechanical property testing according to the Chinese national standard (GB/T 228.1-2010), and the testing results are as shown in Table 3. In addition, in the embodiment III, connection forging of a plurality of forged parts is carried out, which proved that the plurality of forged parts can be connected together to achieve one-heat forging forming, and the forged part is good in surface quality and free of cracks. Meanwhile, when the forged part is sawed into individual forged products, the surface of each forged part is free of defects.

Comparative Example I

A 2A43 plate-shaped forged part is forged, the high-Ag aluminum ingot is prepared from the following components: 0.06% of Si, 0.06% of Fe, 6.3% of Cu, 0.45% of Mg, 1.05% of Ag, 0.4% of Mn, 0.08% of Zr, 0.05% of Ti, and the balance of Al.

The blanking forging steps are as follows:

A high-Ag aluminum ingot is heated using a conventional temperature of 420° C. and then held for 4 hours to obtain a blank; a forging anvil is free of rounding treatment, and the blank is free of holding measures in the process of transferring the blank to a press. A contact portion of the forging anvil, the tong or the die with the aluminum alloy is free of preheating measures. The blank is subjected to six-upsetting six-stretching multi-directional deformation blank forging, wherein the amount of deformation of each pass in each direction is 30%. The pressing speed of the press is 80 mm/s, and the intermediate annealing treatment is carried out in the forging deformation process, wherein the annealing is carried out at the temperature of 430° C. and lasts for 3 h; air cooling is carried out after forging so as to obtain a forging blank; and the final forging temperature is controlled at 340° C. The generation conditions of edge cracks and surface cracks are observed at any time in the blank forging deformation process, and the repairing treatment is treated at any time.

The forming forging steps are as follows:

The forging blank is put into the furnace again to be heated to 400° C. and then held for 6 hours; then the forging blank is rapidly stretched and forged to the specified blank size, the intermediate annealing treatment is carried out repeatedly in such process. The final forging temperature is controlled at 340° C.

The conventional forging process is implemented in the Comparative Example 1, although intermediate annealing is implemented repeatedly in the forging process, the obtained plate-shaped forged part still cracks.

Embodiment IV

A 2A43 cylindrical forged part is forged, wherein the high-Ag aluminum ingot is prepared from the following components: 0.06% of Si, 0.06% of Fe, 6.8% of Cu, 0.35% of Mg, 1.55% of Ag, 0.20% of Mn, 0.08% of Zr, 0.15% of Ti, and the balance of Al.

The blanking forging steps are as follows:

A high-Ag aluminum ingot is heated to 450° C. and held for 14 hours to obtain a blank. A forging anvil is subjected to rounding treatment in advance, with a fillet of R25. In the process of transferring the blank to a press, insulation cotton is adopted for the holding of the blank. A contact portion of the forging anvil, a tong or a die with the aluminum alloy is preheated to 450° C. in advance; the blank is subjected to six-upsetting six-stretching multi-directional deformation blank forging, and the amount of deformation of each pass in each direction is 60%. Pressing is carried out at a low speed of 3 mm/s, and then the pressing speed is gradually increased to 10 mm/s. The increase of the amount of deformation may cause the deformation heat inside the aluminum alloy. For the cylindrical or square forged parts, the heat loss and the generation of internal deformation heat approximately achieve a dynamic balance. At the moment, the repeated upsetting-stretching of the blank may be completed at the condition that the blank temperature doesn't fall outside the final forming temperature range. The air cooling is carried out after forging so as to obtain the forging blank; the final forging temperature is controlled at 400° C. The generation conditions of edge cracks and surface cracks are observed at any time in the blank forging deformation process, and repairing treatment can be carried out at any time.

The forming forging steps are as follows:

The blank obtained after blank forging is put into the furnace again to be heated to 470° C. and then held for 7 hours. The forging clamp, the die and the upsetting iron are preheated, and then the forging blank is subjected to upsetting, punching and core-bar stretching deformation (the amount of deformation is greater than or equal to 20%). A roller of a ring rolling mill is coated with lubricating oil. The steel parts at 1000° C. are subjected to ring rolling in advance. The blank is loaded into a core roller, the forging blank is lightly pressed by using an axial roller, and the axial deformation is carried out by using small amount of deformation (5%). Through the cooperation of a main roller and the core roller, radial ring rolling deformation is carried out by using the large amount of deformation (greater than or equal to 30%), and the final forging temperature is controlled at 380° C. The forged part is subjected to solid solution treatment at the solution treatment process parameters of 500° C./4 hours; the forged part after solid solution treatment is subjected to residual stress elimination treatment with the tensile or bulging amount of deformation of 1.1%; and the forged part is further subjected to artificial aging treatment at the process parameters of 170° C./16 hours.

The cylindrical forged part obtained in the embodiment IV of the present disclosure is good in surface quality and free of defects and cracks. The cylindrical forged part obtained in the embodiment IV is subjected to room-temperature mechanical property testing according to the Chinese national standard (GB/T 228.1-2010), and the testing results are as shown in Table 4.

TABLE 4

| Sampling direction | $\sigma_b$(MPa) | $\sigma_{0.2}$(MPa) | $\delta_5$(%) |
|---|---|---|---|
| High direction | 527 | 501 | 8.0 |
| Tangent direction | 533 | 492 | 8.0 |

Embodiment V

A 2A43 cylindrical forged part is forged, wherein the high-Ag aluminum ingot is prepared from the following components: 0.06% of Si, 0.06% of Fe, 5.9% of Cu, 0.6% of Mg, 0.9% of Ag, 0.4% of Mn, 0.08% of Zr, 0.03% of Ti, and the balance of Al.

The blanking forging steps are as follows:

A high-Ag aluminum ingot is heated to 460° C. and held for 15 hours to obtain a blank. A forging anvil is subjected to rounding treatment in advance, with a fillet of R25. In the process of transferring the blank to a press, insulation cotton is adopted for the holding of the blank. A contact portion of the forging anvil, a tong or a die with the aluminum alloy is preheated to 480° C. in advance; the blank is subjected to six-upsetting six-stretching multi-directional deformation blank forging, and the amount of deformation of each pass in each direction is 40%. Pressing is carried out at a low speed of 4 mm/s, and then the pressing speed is gradually increased to 8 mm/s. The increase of the amount of deformation may cause the deformation heat inside the aluminum alloy. For the cylindrical or square forged parts, the heat loss and the generation of internal deformation heat approximately achieve a dynamic balance. At the moment, the repeated upsetting-stretching of the blank may be completed at the condition that the blank temperature doesn't fall outside the final forming temperature range. The air cooling is carried out after forging so as to obtain the forging blank; the final forging temperature is controlled at 370° C. The generation conditions of edge cracks and surface cracks are observed at any time in the blank forging deformation process, and repairing treatment can be carried out at any time.

The forming forging steps are as follows:

The blank obtained after blank forging is put into the furnace again to be heated to 490° C. and then held for 6 hours. The forging clamp, the die and the upsetting iron are preheated, and then the forging blank is subjected to upsetting, punching and core-bar stretching deformation (the amount of deformation is greater than or equal to 20%). A roller of a ring rolling mill is coated with lubricating oil. The steel parts at 1100° C. are subjected to ring rolling in advance. The blank is loaded into a core roller, the forging blank is lightly pressed by using an axial roller, and the axial deformation is carried out by using small amount of deformation (10%). Through the cooperation of a main roller and the core roller, radial ring rolling deformation is carried out by using the large amount of deformation (greater than or equal to 30%), and the final forging temperature is controlled at 400° C. The forged part is subjected to solid solution treatment at the solution treatment process parameters of 510° C./4 hours; the forged part after solid solution treatment is subjected to residual stress elimination treatment with the tensile or bulging amount of deformation of 0.9%; and the forged part is further subjected to artificial aging treatment at the process parameters of 160° C./22 hours.

The cylindrical forged part obtained in the embodiment V of the present disclosure is good in surface quality and free of defects and cracks. The cylindrical forged part obtained in the embodiment V is subjected to room-temperature mechanical property testing according to the Chinese national standard (GB/T 228.1-2010), and the testing results are as shown in Table 5.

TABLE 5

| Sampling direction | $\sigma_b$(MPa) | $\sigma_{0.2}$(MPa) | $\delta_5$(%) |
|---|---|---|---|
| High direction | 484 | 448 | 6.5 |
| Tangent direction | 506 | 459 | 6.5 |

Embodiment VI

A 2A43 cylindrical forged part is forged, wherein the high-Ag aluminum ingot is prepared from the following components: 0.06% of Si, 0.06% of Fe, 6.2% of Cu, 0.55% of Mg, 1.85% of Ag, 0.20% of Mn, 0.09% of Zr, 0.14% of Ti, and the balance of Al.

The blanking forging steps are as follows:

A high-Ag aluminum ingot is heated to 450° C. and held for 13 hours to obtain a blank. A forging anvil is subjected to rounding treatment in advance, with a fillet of R25. In the process of transferring the blank to a press, insulation cotton is adopted for the holding of the blank. A contact portion of the forging anvil, a tong or a die with the aluminum alloy is preheated to 340° C. in advance; the blank is subjected to six-upsetting six-stretching multi-directional deformation blank forging, and the amount of deformation of each pass in each direction is 40%. Pressing is carried out at a low speed of 3 mm/s, and then the pressing speed is gradually increased to 9 mm/s. The increase of the amount of deformation may cause the deformation heat inside the aluminum alloy. For the cylindrical or square forged parts, the heat loss and the generation of internal deformation heat approximately achieve a dynamic balance. At the moment, the repeated upsetting-stretching of the blank may be completed at the condition that the blank temperature doesn't fall outside the final forming temperature range. The air cooling is carried out after forging so as to obtain the forging blank; the final forging temperature is controlled at 400° C. The generation conditions of edge cracks and surface cracks are observed at any time in the blank forging deformation process, and repairing treatment can be carried out at any time.

The forming forging steps are as follows:

The blank obtained after blank forging is put into the furnace again to be heated to 470° C. and then held for 6 hours. The forging clamp, the die and the upsetting iron are preheated, and then the forging blank is subjected to upsetting, punching and core-bar stretching deformation (the amount of deformation is greater than or equal to 20%). A roller of a ring rolling mill is coated with lubricating oil. The steel parts at 1000° C. are subjected to ring rolling in advance. The blank is loaded into a core roller, the forging blank is lightly pressed by using an axial roller, and the axial deformation is carried out by using small amount of deformation (15%). Through the cooperation of a main roller and the core roller, radial ring rolling deformation is carried out by using the large amount of deformation (greater than or equal to 30%), and the final forging temperature is controlled at 370° C. The forged part is subjected to solid solution treatment at the solution treatment process parameters of 520° C./3 hours; the forged part after solid solution treatment is subjected to residual stress elimination treatment with the tensile or bulging amount of deformation of 1.5%; and the forged part is further subjected to artificial aging treatment at the process parameters of 165° C./18 hours.

The cylindrical forged part obtained in the embodiment VI of the present disclosure is good in surface quality and free of defects and cracks. The cylindrical forged part obtained in the embodiment VI is subjected to room-temperature mechanical property testing according to the Chinese national standard (GB/T 228.1-2010), and the testing results are as shown in Table 6.

TABLE 6

| Sampling direction | $\sigma_b$(MPa) | $\sigma_{0.2}$(MPa) | $\delta_5$(%) |
|---|---|---|---|
| High direction 1 | 506 | 466 | 7.5 |
| High direction 2 | 499 | 462 | 6.5 |
| Tangent direction 1 | 504 | 478 | 7.0 |
| Tangent direction 2 | 495 | 463 | 10.5 |

Embodiment VII

A 2A43 cylindrical forged part is forged, wherein the high-Ag aluminum ingot is prepared from the following components: 0.06% of Si, 0.06% of Fe, 6.4% of Cu, 0.45% of Mg, 1.35% of Ag, 0.4% of Mn, 0.10% of Zr, 0.12% of Ti, and the balance of Al.

The blanking forging steps are as follows:

A high-Ag aluminum ingot is heated to 500° C. and held for 8 hours to obtain a blank. A forging anvil is subjected to rounding treatment in advance, with a fillet of R25. In the process of transferring the blank to a press, insulation cotton is adopted for the holding of the blank. A contact portion of the forging anvil, a tong or a die with the aluminum alloy is preheated to 480° C. in advance; the blank is subjected to six-upsetting six-stretching multi-directional deformation blank forging, and the amount of deformation of each pass in each direction is 50%. Pressing is carried out at a low speed of 3 mm/s, and then the pressing speed is gradually increased to 10 mm/s. The increase of the amount of deformation may cause the deformation heat inside the aluminum alloy. For the cylindrical or square forged parts, the heat loss and the generation of internal deformation heat approximately achieve a dynamic balance. At the moment, the repeated upsetting-stretching of the blank may be completed at the condition that the blank temperature doesn't fall outside the final forming temperature range. The air cooling is carried out after forging so as to obtain the forging blank; the final forging temperature is controlled at 360° C. The generation conditions of edge cracks and surface cracks are observed at any time in the blank forging deformation process, and repairing treatment can be carried out at any time.

The forming forging steps are as follows:

The blank obtained after blank forging is put into the furnace again to be heated to 470° C. and then held for 6 hours. The forging clamp, the die and the upsetting iron are preheated, and then the forging blank is subjected to upsetting, punching and core-bar stretching deformation (the amount of deformation is greater than or equal to 20%). A roller of a ring rolling mill is coated with lubricating oil. The steel parts at 1100° C. are subjected to ring rolling in advance. The blank is loaded into a core roller, the forging blank is lightly pressed by using an axial roller, and the axial deformation is carried out by using small amount of deformation (20%). Through the cooperation of a main roller and the core roller, radial ring rolling deformation is carried out by using the large amount of deformation (greater than or equal to 30%), and the final forging temperature is controlled at 400° C. The forged part is subjected to solid solution treatment at the solution treatment process parameters of 515° C./4 hours; the forged part after solid solution treatment is subjected to residual stress elimination treatment with the tensile or bulging amount of deformation of 2.0%; and the forged part is further subjected to artificial aging treatment at the process parameters of 180° C./12 hours.

The cylindrical forged part obtained in the embodiment VII of the present disclosure is good in surface quality and free of defects and cracks. The cylindrical forged part obtained in the embodiment VII is subjected to room-temperature mechanical property testing according to the Chinese national standard (GB/T 228.1-2010), and the testing results are as shown in Table 7.

TABLE 7

| Sampling direction | $\sigma_b$(MPa) | $\sigma_{0.2}$(MPa) | $\delta_5$(%) |
|---|---|---|---|
| High direction 1 | 498 | 459 | 7.0 |
| High direction 2 | 488 | 448 | 7.5 |
| Tangent direction 1 | 486 | 456 | 8.0 |
| Tangent direction 2 | 488 | 458 | 9.0 |

Embodiment VIII

A 2A43 cylindrical forged part is forged, wherein the high-Ag aluminum ingot is prepared from the following components: 0.06% of Si, 0.06% of Fe, 6.7% of Cu, 0.25% of Mg, 1.25% of Ag, 0.3% of Mn, 0.08% of Zr, 0.03% of Ti, and the balance of Al.

The blanking forging steps are as follows:

A high-Ag aluminum ingot is heated to 440° C. and held for 16 hours to obtain a blank. A forging anvil is subjected to rounding treatment in advance, with a fillet of R25. In the process of transferring the blank to a press, insulation cotton is adopted for the holding of the blank. A contact portion of the forging anvil, a tong or a die with the aluminum alloy is preheated to 300° C. in advance; the blank is subjected to six-upsetting six-stretching multi-directional deformation blank forging, and the amount of deformation of each pass in each direction is 60%. Pressing is carried out at a low speed of 4 mm/s, and then the pressing speed is gradually increased to 10 mm/s. The increase of the amount of deformation may cause the deformation heat inside the aluminum alloy. For the cylindrical or square forged parts, the heat loss and the generation of internal deformation heat approximately achieve a dynamic balance. At the moment, the repeated upsetting-stretching of the blank may be completed at the condition that the blank temperature doesn't fall outside the final forming temperature range. The air cooling is carried out after forging so as to obtain the forging blank; the final forging temperature is controlled at 390° C. The generation conditions of edge cracks and surface cracks are observed at any time in the blank forging deformation process, and repairing treatment can be carried out at any time.

The forming forging steps are as follows:

The blank obtained after blank forging is put into the furnace again to be heated to 500° C. and then held for 6 hours. The forging clamp, the die and the upsetting iron are preheated, and then the forging blank is subjected to upsetting, punching and core-bar stretching deformation (the amount of deformation is greater than or equal to 20%). A roller of a ring rolling mill is coated with lubricating oil. The steel parts at 1000° C. are subjected to ring rolling in advance. The blank is loaded into a core roller, the forging blank is lightly pressed by using an axial roller, and the axial deformation is carried out by using small amount of deformation (10%). Through the cooperation of a main roller and the core roller, radial ring rolling deformation is carried out by using the large amount of deformation (greater than or equal to 30%), and the final forging temperature is controlled at 370° C. The forged part is subjected to solid solution treatment at the solution treatment process parameters of 505° C./5 hours; the forged part after solid solution treatment is subjected to residual stress elimination treatment with the tensile or bulging amount of deformation of 0.8%; and the forged part is further subjected to artificial aging treatment at the process parameters of 175° C./14 hours.

The cylindrical forged part obtained in the embodiment VIII of the present disclosure is good in surface quality and free of defects and cracks. The cylindrical forged part obtained in the embodiment VIII is subjected to room-temperature mechanical property testing according to the Chinese national standard (GB/T 228.1-2010), and the testing results are as shown in Table 8.

TABLE 8

| Sampling direction | $\sigma_b$(MPa) | $\sigma_{0.2}$(MPa) | $\delta_5$(%) |
|---|---|---|---|
| High direction 1 | 507 | 467 | 8.0 |
| High direction 2 | 500 | 476 | 7.6 |
| Tangent direction 1 | 505 | 476 | 8.5 |
| Tangent direction 2 | 503 | 476 | 7.6 |

Embodiment IX

A 2A43 forged ring is forged, wherein the high-Ag aluminum ingot is prepared from the following components: 0.06% of Si, 6.5% of Cu, 0.55% of Mg, 1.65% of Ag, 0.2% of Mn, 0.08% of Zr, 0.11% of Ti, and the balance of Al.

The blanking forging steps are as follows:

A high-Ag aluminum ingot is heated to 450° C. and held for 15 hours to obtain a blank. A forging anvil is subjected to rounding treatment in advance, with a fillet of R25. In the process of transferring the blank to a press, insulation cotton is adopted for the holding of the blank. A contact portion of the forging anvil, a tong or a die with the aluminum alloy is preheated to 320° C. in advance; the blank is subjected to six-upsetting six-stretching multi-directional deformation blank forging, and the amount of deformation of each pass in each direction is 60%. Pressing is carried out at a low speed of 3 mm/s, and then the pressing speed is gradually increased to 10 mm/s. The increase of the amount of deformation may cause the deformation heat inside the aluminum alloy. For the cylindrical or square forged parts, the heat loss and the generation of internal deformation heat approximately achieve a dynamic balance. At the moment, the repeated upsetting-stretching of the blank may be completed at the condition that the blank temperature doesn't fall outside the final forming temperature range. The air cooling is carried out after forging so as to obtain the forging blank; the final forging temperature is controlled at 400° C. The generation conditions of edge cracks and surface cracks are observed at any time in the blank forging deformation process, and repairing treatment can be carried out at any time.

The forming forging steps are as follows:

The blank obtained after blank forging is put into the furnace again to be heated to 500° C. and then held for 6 hours. The forging clamp, the die and the upsetting iron are preheated, and then the forging blank is subjected to upsetting, punching and core-bar stretching deformation (the amount of deformation is greater than or equal to 15%). A roller of a ring rolling mill is coated with lubricating oil. The steel parts at 1000° C. are subjected to ring rolling in advance. The blank is loaded into a core roller, the forging blank is lightly pressed by using an axial roller, and the axial deformation is carried out by using small amount of deformation (20%). Through the cooperation of a main roller and the core roller, radial ring rolling deformation is carried out by using the large amount of deformation (greater than or equal to 40%), and the final forging temperature is controlled at 370° C. The forged part is subjected to solid solution treatment at the solution treatment process parameters of 518° C./4 hours; the forged part after solid solution treatment is subjected to residual stress elimination treatment with the tensile or bulging amount of deformation of 1.3%; and the forged part is further subjected to artificial aging treatment at the process parameters of 155° C./24 hours.

The forged ring obtained in the embodiment IX of the present disclosure is good in surface quality and free of defects and cracks. The forged ring obtained in the embodiment IX is subjected to room-temperature mechanical property testing according to the Chinese national standard (GB/T 228.1-2010), and the testing results are as shown in Table 9.

TABLE 9

| Sampling direction | $\sigma_b$(MPa) | $\sigma_{0.2}$(MPa) | $\delta_5$(%) |
|---|---|---|---|
| High direction 1 | 553 | 514 | 7.0 |
| High direction 2 | 553 | 511 | 7.0 |
| Tangent direction 1 | 545 | 518 | 10.0 |
| Tangent direction 2 | 538 | 514 | 11.0 |

Comparative Example II

A 2A43 cylindrical forged part is forged, wherein the high-Ag aluminum ingot is prepared from the following components: 0.06% of Si, 0.06% of Fe, 5.6% to 6.8% of Cu, 0.25% to 0.6% of Mg, 0.9% to 1.85% of Ag, 0.2% to 0.4% of Mn, 0.08% to 0.10% of Zr, 0.03% to 0.15% of Ti, and the balance of Al.

The blanking forging steps are as follows:

A high-Ag aluminum ingot is heated using a conventional temperature 430° C. and held for 6 hours to obtain a blank. A forging anvil is subjected to rounding treatment in advance, with a fillet of R25. In the process of transferring the blank to a press, insulation cotton is adopted for the holding of the blank. A contact portion of the forging anvil, a tong or a die with the aluminum alloy is preheated to 300° C. in advance; the blank is subjected to six-upsetting six-stretching multi-directional deformation blank forging, and the amount of deformation of each pass in each direction is 40%. Pressing is carried out at a low speed of 4 mm/s, and then the pressing speed is gradually increased to 10 mm/s. The intermediate annealing treatment is carried out in the forging deformation process, wherein the annealing is carried out at the temperature of 400° C. and lasts for 5 h. The air cooling is carried out after forging so as to obtain the forging blank; and the final forging temperature is controlled at 360° C. The generation conditions of edge cracks and surface cracks are observed at any time in the blank forging deformation process, and repairing treatment can be carried out at any time.

The forming forging steps are as follows:

The blank obtained after blank forging is put into the furnace again to be heated to 400° C. and then held for 6 hours. The forging clamp, the die and the upsetting iron are preheated, and then the forging blank subjected to blank forging and upsetting is subjected to punching. There is no additional upsetting for the forging blank, and no core-bar stretching deformation is required after punching. A roller of a ring rolling mill is coated with the lubricating oil, and steel parts at 1000° C. are subjected to ring rolling in advance. The blank is loaded into a core roller, the forging blank is lightly pressed by using an axial roller, and axial deformation is carried out by using the small amount of deformation (15%). Through the cooperation of a main roller and the core roller, radial ring rolling deformation is carried out by using the large amount of deformation (greater than or equal to 30%), and the final forging temperature is controlled at 360° C.

The cylindrical forged part prepared in the Comparative Example 2 cracks in the ring rolling process and is poor in surface quality.

Comparative Example III

A 2A43 cylindrical forged part is forged, wherein the high-Ag aluminum ingot is prepared from the following components: 0.06% of Si, 0.06% of Fe, 5.8% of Cu, 0.6% of Mg, 1.05% of Ag, 0.4% of Mn, 0.08% of Zr, 0.05% of Ti, and the balance of Al.

The blanking forging steps are as follows:

A high-Ag aluminum ingot is heated using a conventional temperature 440° C. and held for 16 hours to obtain a blank. A forging anvil is subjected to rounding treatment in advance, with a fillet of R25. In the process of transferring the blank to a press, insulation cotton is adopted for the holding of the blank. A contact portion of the forging anvil, a tong or a die with the aluminum alloy is preheated to 300° C. in advance; the blank is subjected to six-upsetting six-stretching multi-directional deformation blank forging, and the amount of deformation of each pass in each direction is 40%. Pressing is carried out at a low speed of 3 mm/s, and then the pressing speed is gradually increased to 9 mm/s. The intermediate annealing treatment is carried out in the forging deformation process, wherein the annealing is carried out at the temperature of 440° C. and lasts for 3 h. The air cooling is carried out after forging so as to obtain the forging blank; and the final forging temperature is controlled at 400° C. The generation conditions of edge cracks and surface cracks are observed at any time in the blank forging deformation process, and repairing treatment can be carried out at any time.

The forming forging steps are as follows:

The blank obtained after blank forging is put into the furnace again to be heated to 460° C. and then held for 6 hours. The forging clamp, the die and the upsetting iron are preheated, and then the forging blank subjected to blank forging and upsetting is subjected to punching. There is no additional upsetting for the forging blank, and no core-bar stretching deformation is required after punching. A roller of a ring rolling mill is coated with the lubricating oil, and steel parts at 1000° C. are subjected to ring rolling in advance. The blank is loaded into a core roller, the forging blank is lightly pressed by using an axial roller, and axial deformation is carried out by using the small amount of deformation (10%). Through the cooperation of a main roller and the core roller, radial ring rolling deformation is carried out by using the large amount of deformation (greater than or equal to 30%), and the final forging temperature is controlled at 400° C.

The forged part is subjected to solid solution treatment at the solution treatment process parameters of 510° C./4 hours; the forged part after solid solution treatment is subjected to residual stress elimination treatment with the tensile or bulging amount of deformation of 1.2%; and the forging is further subjected to artificial aging treatment at the process parameters of 175° C./16 hours.

The room-temperature mechanical property of the cylindrical forged part obtained in the Comparative Example III is as shown in Table 10 (GB/T 228.1-2010), and it can be known that the elongation in the high direction is much lower than that in the tangent direction. Such situation is caused by one-way blank forging deformation, small amount of deformation and no core-bar stretching forging process.

TABLE 10

| Sampling direction | $\sigma_b$(MPa) | $\sigma_{0.2}$(MPa) | $\delta_5$(%) |
|---|---|---|---|
| High direction 1 | 502 | 467 | 6.0 |
| High direction 2 | 500 | 462 | 4.8 |
| High direction 3 | 499 | 469 | 4.0 |
| Tangent direction 1 | 495 | 462 | 10.0 |
| Tangent direction 2 | 514 | 486 | 9.6 |
| Tangent direction 3 | 502 | 473 | 10.0 |

The foregoing is merely a preferred embodiment of the present disclosure and is not intended to limit the present disclosure, and any modifications, equivalents, improvements and the like made within the spirit and principles of the present disclosure are intended to be encompassed within the scope of the present disclosure.

What is claimed is:

1. A forging method for a high-silver aluminum alloy, comprising the following steps:

heating the high-silver aluminum alloy to 440° C. to 500° C., and holding for 8 hours to 16 hours to obtain a blank;

preheating a contact portion of a forging anvil, a tong or a die with the blank to 300° C. to 480° C., and holding the contact portion at that temperature while transferring the blank to a press;

carrying out six-upsetting six-stretching multidirectional forging deformation on the blank at a pressing speed of the press of 3 mm/s to 10 mm/s, thus obtaining a forging blank, wherein the final forging temperature is 360° C. to 400° C.;

carrying out forming forging treatment on the forging blank to obtain a forged part; and carrying out solid solution treatment, residual stress elimination and artificial aging treatment in sequence;

wherein the high-silver aluminum alloy is prepared from the following components in percentage by weight: less than or equal to 0.06% of Si, less than or equal to 0.05% of Fe, 5.6% to 6.8% of Cu, 0.25% to 0.6% of Mg, 0.9% to 1.85% of Ag, 0.2% to 0.4% of Mn, 0.08% to 0.10% of Zr, 0.03% to 0.15% of Ti, and the balance of Al.

2. The forging method for the high-silver aluminum alloy according to claim 1, wherein, before the step of preheating the contact portion of the forging anvil, the tong or the die with the blank to 300° C. to 480° C., and holding the contact portion at that temperature while transferring the blank to the press, the method further comprises:

carrying out rounding treatment on the forging anvil in advance.

3. The forging method for the high-silver aluminum alloy according to claim 1, wherein the step of carrying out six-upsetting six-stretching multi-directional forging deformation on the blank at a pressing speed of the press of 3 mm/s to 10 mm/s so as to obtain a forging blank comprises:

carrying out six-upsetting six-stretching multi-directional forging deformation on the blank, wherein the amount of deformation of each pass in each direction is 40% to 60%; carrying out pressing deformation at the pressing speed of 3 mm/s to 5 mm/s, and then increasing the pressing speed to 7 mm/s to 10 mm/s, thus obtaining the forging blank.

4. The forging method for the high-silver aluminum alloy according to claim 1, wherein the step of carrying out six-upsetting six-stretching multi-directional forging deformation on the blank at a pressing speed of the press of 3 mm/s to 10 mm/s so as to obtain a forging blank comprises:

carrying out six-upsetting six-stretching multi-directional forging deformation on the blank at a pressing speed of the press of 3 mm/s to 10 mm/s, and carrying out intermediate annealing treatment in the forging deformation process to obtain the forging blank, wherein the intermediate annealing treatment is carried out at the temperature of 420° C. to 480° C. and lasts for 4 hours to 8 hours.

5. The forging method for the high-silver aluminum alloy according to claim 1, wherein the forged part is a plate-shaped or rod-shaped forged part, and the step of carrying out forming forging treatment on the forging blank to obtain the forged part comprises:

stretching and forging the forging blank to a specified blank size after the forging blank is heated to 440° C. to 500° C. and held for 6 hours to 8 hours, with the amount of deformation of greater than or equal to 80%, thus obtaining the plate-shaped or rod-shaped forged part.

6. The forging method for the high-silver aluminum alloy according to claim 1, wherein the solid solution treatment is carried out at the temperature of 480° C. to 520° C. and lasts for 3 hours to 6 hours.

7. The forging method for the high-silver aluminum alloy according to claim 1, wherein the amount of tensile or bulging deformation of the residual stress elimination treatment is 0.1% to 2.0%.

8. The forging method for the high-silver aluminum alloy according to claim 1, wherein the artificial aging treatment is carried out at the temperature of 150° C. to 180° C. and lasts for 12 hours to 24 hours.

9. The forging method for the high-silver aluminum alloy according to claim 1, wherein the forged part is a forged ring, and the step of carrying out forming forging treatment on the forging blank to obtain the forged part comprises:

carrying out upsetting, punching and core-bar stretching on the forging blank after the forging blank is heated to 440° C. to 500° C. and held for 6 hours to 8 hours, thus obtaining a ring blank;

carrying out ring rolling of a steel ring in advance, and heating a roller by using the steel ring at the temperature of 1000° C. to 1100° C.; and loading the ring blank into a core roller, pressing the ring blank using an axial roller, carrying out axial deformation by using the amount of deformation of 5% to 20%, and by means of the cooperation of a main roller and the core roller, carrying out radial ring rolling deformation by using the amount of deformation of greater than or equal to 30%, thus obtaining the forged ring.

* * * * *